United States Patent [19]

Vaddiparty

[11] Patent Number: 4,647,879

[45] Date of Patent: Mar. 3, 1987

[54] RADIAL/AXIAL POWER DIVIDER/COMBINER

[75] Inventor: Yerriah P. Vaddiparty, San Jose, Calif.

[73] Assignee: Ford Aerospace & Communications Corporation, Detroit, Mich.

[21] Appl. No.: 752,764

[22] Filed: Jul. 8, 1985

[51] Int. Cl.[4] ..... H01P 5/12

[52] U.S. Cl. ..... 333/127; 333/128

[58] Field of Search ..... 333/104, 125, 127, 128, 333/136; 330/286

[56] References Cited

U.S. PATENT DOCUMENTS

| | | | |
|---|---|---|---|
| 3,662,285 | 5/1972 | Rucker | 333/125 X |
| 4,302,734 | 11/1981 | Stockton et al. | 333/104 |
| 4,375,622 | 3/1983 | Hollingsworth et al. | 333/127 X |

*Primary Examiner*—Paul Gensler

*Attorney, Agent, or Firm*—Edward J. Radlo; Clifford L. Sadler

[57] ABSTRACT

An electromagnetic power divider/combiner comprises N radial outputs (31) having equal powers and preferably equal phases, and a single axial output (20). A divider structure (1) and a preferably identical combiner structure (2) are broadside coupled across a dielectric substrate (30) containing on one side the network of N radial outputs (31) and on its other side a set of N equispaced stubs (42) which are capacitively coupled through the dielectric substrate (30) to the N radial outputs (31). The divider structure (1) and the combiner structure (2) each comprise a dielectric disk (12, 22, respectively) on which is mounted a set of N radial impedance transformers (14, 24, respectively). Gross axial coupling is determined by the thickness of the dielectric layer (30). Rotating the disks (12, 22) with respect to each other effectuates fine adjustment in the degree of axial coupling.

11 Claims, 3 Drawing Figures

RADIAL/AXIAL POWER DIVIDER/COMBINER

STATEMENT OF GOVERNMENT INTEREST

The invention described herein was partially made in the performance of work under NASA Cpntract No. JPL-957333 and is subject to the provisions of Section 305 of the National Aeronautics and Space Act of 1958 (72 Stat. 435; 42 U.S.C. 2457).

DESCRIPTION

1. Technical Field

This invention pertains to the field of dividing and combining electromagnetic power.

2. Background Art

U.S. Pat. No. 4,234,854 describes an amplifier which includes a radial structure that divides the input power, piecewise amplifies it, and then recombines it. This device differs from that of the present invention in that: (1) the only output is coaxial, as compared with the radial and coaxial components in the present invention; (2) it amplifies the input power, whereas the present invention does not; and (3) it is much more difficult in the patented device to control the phase and amplitude within the individual pieces.

U.S. Pat. Nos. 4,263,568, 4,328,471, and 4,371,845 disclose radial power dividers which do not have the axial output of the present invention.

U.S. Pat. Nos. 4,129,839, 4,254,386, and 4,463,326 disclose planar dividers which do not have the equispaced radial components or the axial component of the present invention.

DISCLOSURE OF INVENTION

The electromagnetic power divider/combiner of the present invention features an elongated input conductor (10), such as the inner conductor of a coaxial cable, which conveys the electromagnetic input energy. Generally orthogonal to the input conductor (10) is a substantially planar layer (3) comprising N elongated radially-oriented conductors (31) each of which conveys an equal percentage of the power that originated at the input conductor (10). Each of the radial outputs (31) is directly electrically coupled to the input conductor (10). Generally colinear with the input conductor (10) and separated therefrom by a dielectric portion (30) of the planar layer (3) is an elongated axial output conductor (20).

Input conductor (10) is coupled to the radial outputs (31) by means of N divider impedance transformers (14), each generally a quarter wavelength long at the design frequency, radially grouped on a dielectric disk (12). Similarly, the axial output conductor (20) is capacitively coupled to each of the radial outputs (31) by means of N combiner impedance transformers (24) that are radially arranged on a dielectric combiner disk (22). The divider disk (12) and input conductor (10) are principal ingredients of a divider structure (1). Similarly, the combiner disk (22) and the axial output conductor (20) are principal ingredients of a combiner structure (2). The divider structure (1) and the combiner structure (2) are preferably identical. Each pair of transformers (14, 24) constitutes a power coupler.

The thickness of dielectric layer (30) governs the percentage of power that couples into the axial output (20). Fine tuning of this percentage is effectuated by means of rotation of the combiner structure (2) with respect to the divider structure (1).

BRIEF DESCRIPTION OF THE DRAWINGS

These and other more detailed and specific objects and features of the present invention are more fully disclosed in the following specification, reference being had to the accompanying drawings, in which.

BEST MODE FOR CARRYING OUT THE INVENTION

Figure 1:
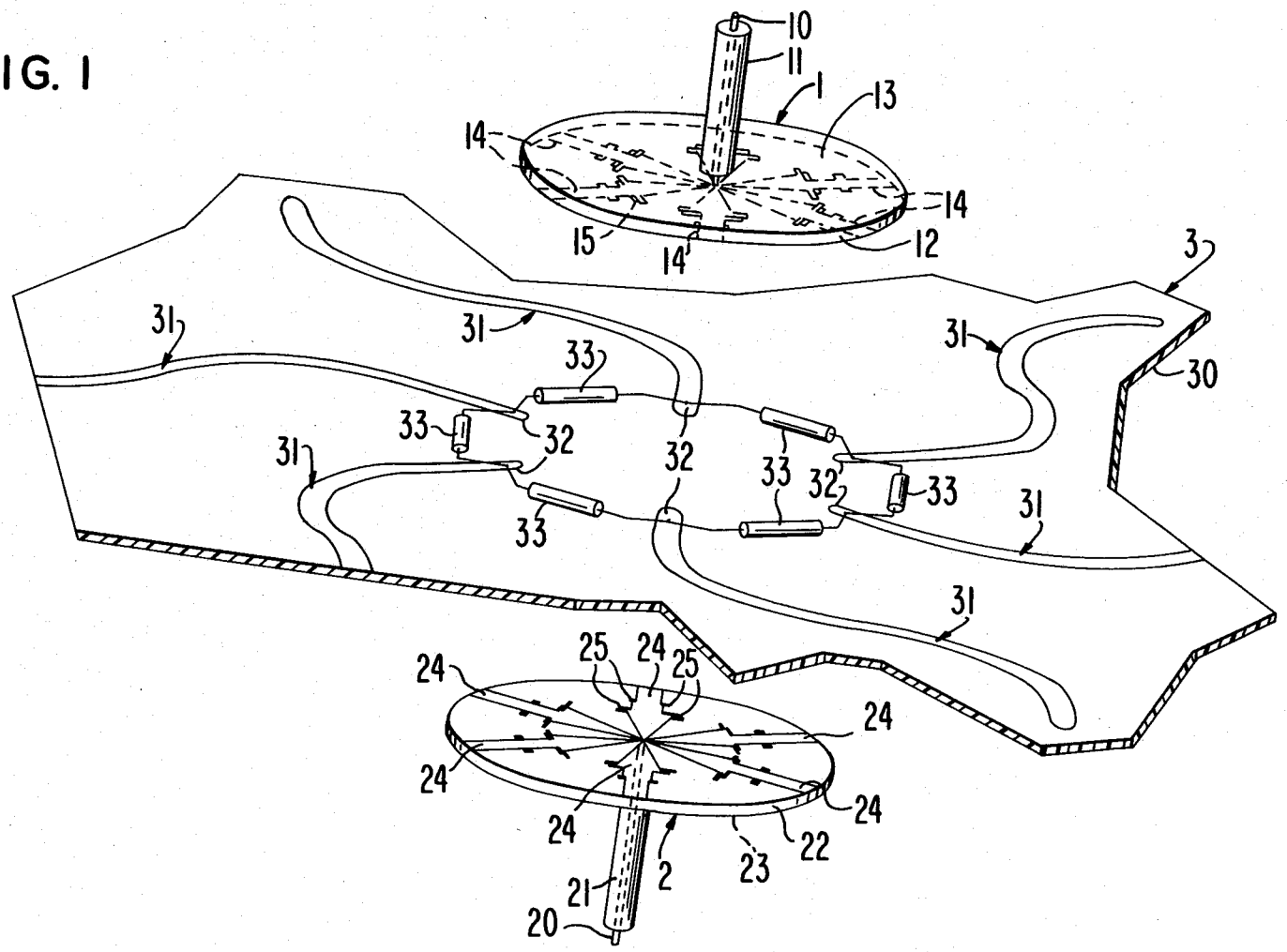
FIG. 1 is an exploded isometric view of a preferred embodiment of the present invention.
Figure 2:
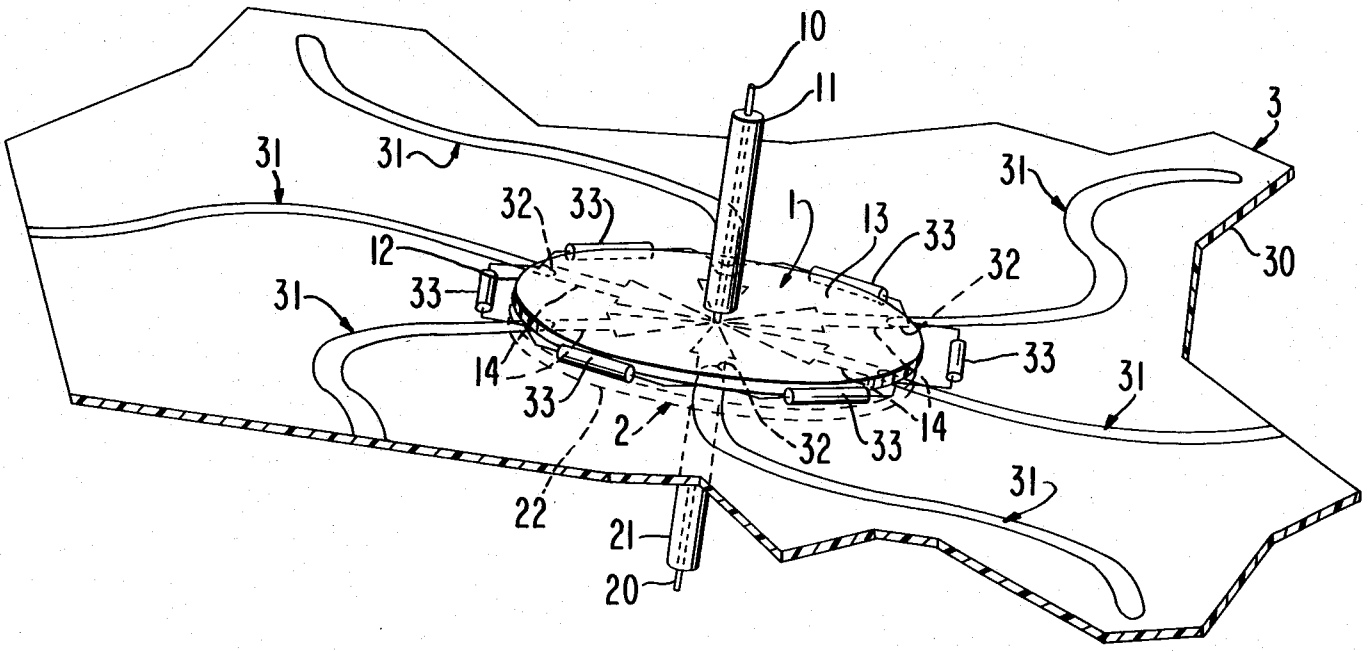
FIG. 2 is a nonexploded isometric view of the embodiment of the present invention that is illustrated in FIG. 1.

In the embodiment illustrated herein, N is equal to 6; however, N can be any positive integer subject only to the constraints of physical crowding.

Input conductor 10 is shown as the center conductor of a coaxial cable having an outer conductor 11, which is grounded to the conductive upper (with respect to the arbitrary perspective of the Figures) surface 13 of dielectric disk 12. Layer 13 is typically a thin metallized layer adhering to disk 12. Center conductor 10 passes through disk 12 and is connected on the bottom side thereof to the center point of a radial network of N impedance transformers 14 which are preferably substantially identical and radially equispaced about disk 12.

Each impedance transformer 14 is tapered, having a narrow end connected to conductor 10 at the mid-point of the bottom surface of disk 12, and a wide end positioned radially outwardly from said mid-point. The widths of the impedance transformers 14 are a function of the desired impedance. The length of each impedance transformer 14 is a function of the electromagnetic frequency and the desired impedance transformation ratio. For example, if the input impedance seen by conductor 10 is 50 ohms and it is desired to maintain this 50 ohm impedance at each of the radial outputs 31, then each impedance transformer 14 must be a 6 to 1 transformer, since this will transform the impedance from 50 ohms to 300 ohms at the mid-point of disk 12 (six 300 ohm impedances in parallel are equivalent to a single 50 ohm impedance).

Tuning stubs 15, typically lumps of indium or gold, are placed on transformers 14 as desired to achieve fine tuning. Transformers 14 are preferably thin, conductive layers of, e.g., copper. Since it is desired to maintain balance in the power and preferably in the phase at the radial outputs 31, the dimensions of transformers 14 in the area of the mid-point of disk 12 are critical. Techniques of photolithography can be gainfully employed to maintain the desired accuracy. For example, a drawing of the desired geometry, orders of magnitude larger than the dimensions of the final divider/combiner, is accurately made. Photographic techniques are used to reduce this drawing to the desired dimensions of the mask that etches the copper on the dielectric board 12. This results in greater accuracy than if the initial drawing were made to scale. Similar techniques, which offer the additional advantage of facilitating mass production, are used for combiner structure 2.

Figure 3:
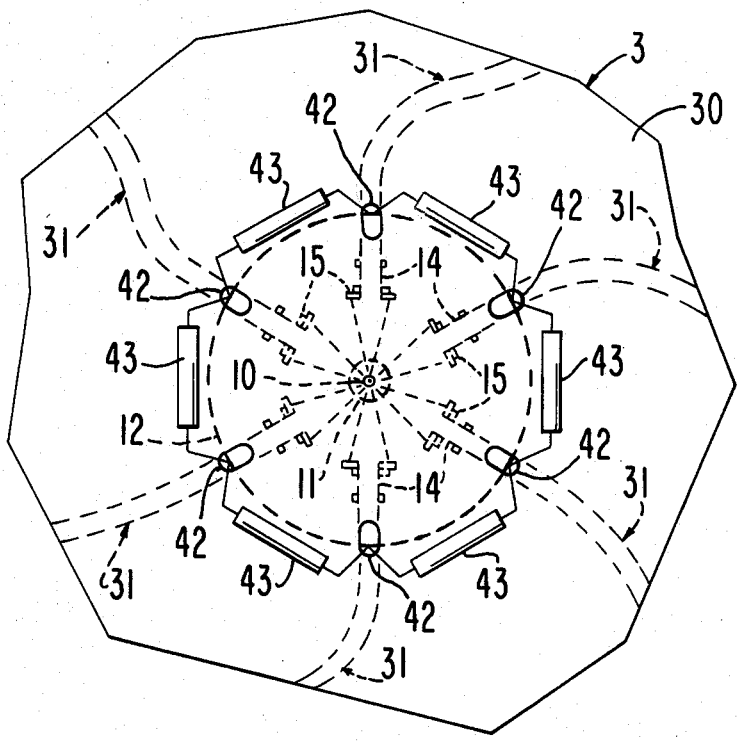
FIG. 3 is a plan view of the underside of the dielectric board 30 that is illustrated in FIGS. 1 and 2.

Radial outputs 31 are thin conductive layers of, e.g., etched copper mounted on the upper surface of dielectric board 30. Each radial output 31 terminates at its radially inner end at a stub 32, which forms an electrical connection with a radially outer end of a corresponding one of the transformers 14. An isolation resistor 33 is connected between each pair of radial outputs 31 at the radially outward ends of corresponding stubs 32. Preferably, resistors 33 are substantially equal in resistance and are thinner than disk 12, but are much thicker than tracings 31 and 14. Disk 12 is dimensioned so that it just fits within the ring formed by resistors 33 (see FIG. 3). In the illustrated embodiment, resistors 33 are each between 100 and 150 ohms. The function of resistors 33 is to tie down the phase at each of the radial outputs 31. Thus, at any given distance along each of the radial outputs 31, the phase is substantially the same. This characteristic, coupled with the fact that the power is substantially the same at any distance along each of the radial outputs 31, is highly desirable for many applications, such as when radial outputs 31 feed antennas.

On the bottom of dielectric board 30 (illustrated in FIG. 3) N electrically conductive stubs 42 are equispaced around the periphery of a circle corresponding to the location of disk 12. Stubs 42 are aligned with the N stubs 32 that are situated on the other side of dielectric board 30, and are separated therefrom physically and electrically by dielectric 30. Thus, each pair of transformer sectors 14, 24 is capacitively coupled broadside, allowing flow of electromagnetic power from 14 to 24. An isolation resistor 43 is electrically connected between each pair of adjacent stubs 42. Preferably, resistors 43 are equal in resistance to each other and to the resistances of resistors 33. The function of resistors 43 is also to maintain phase relationships fixed.

Combiner structure 2 is preferably identical to divider structure 1, and is axially aligned therewith. Thus, combiner disk 22 is fabricated of a dielectric material. The underside of disk 22 is coated by conductive layer 23 connected to outer conductive shield 21 of the coaxial cable whose inner conductor is axial output 20. N combiner impedance transformers 24, having impedance matching stubs 25, are equispaced radially on the upper surface of disk 22. The wide end of each transformer 24 is in electrically conductive contact with one of the stubs 42. By means of this technique, power coupled into each of the six impedance transformers/sectors 24 from the impedance transformers/sectors 14 is combined into the coaxial output line 20. A negligible portion of the axial energy is coupled by means of capacitive coupling between the ends of conductors 10 and 20. The amount of axial coupling is primarily regulated by the thickness of dielectric layer 30. For maximum axial coupling, typically about 50%, dielectric 30 should be as thin as possible (but still have a finite thickness). For maximum axial coupling given the thickness of dielectric 30, each pair of transformers 14, 24 is axially aligned. A small amount of relative rotation between disks 12 and 22 can advantageously be employed to intentionally detune the device off the point of maximum axial coupling. For example, if it is desired to have 50 percent axial coupling, the device is designed so that total axial alignment between each pair of transformers 14, 24 will result in about 55 percent axial coupling. Then disks 12, 24 are very slightly rotated with respect to each other until the device is sufficiently detuned that the desired 50 percent axial coupling is achieved. In general, the device is designed so that the maximum degree of axial coupling is slightly more than what is actually desired, since detuning but not supertuning is possible.

Typically, N and the axial/radial output power ratio, R, are preselected based upon systems considerations. R is defined to be Pa/Pr2, where Pa is the amount of axial power taken from output 20, and Pr2 is the amount of power flowing through each radial output 31. The capacitive coupling coefficient C=Pr3/Pr2 is then calculated from the formula C=R/N, where Pr3 is the amount of power flowing through each combiner impedance transformer 24.

For example, if the input power is 96 watts and N is 6, the amount of power in each of the divider transformers 14 is 16 watts. Assume that it is desired that R be equal to 3.6. This is accomplished by having Pa be 36 watts, and each Pr2 be 10 watts. C is then calculated to be 0.6. The requisite thickness for dielectric layer 30 to achieve C equals 0.6 can then be obtained experimentally or analytically by using known techniques.

The above description is included to illustrate the operation of the preferred embodiments and is not meant to limit the scope of the invention. The scope of the invention is to be limited only by the following claims. From the above discussion, many variations will be apparent to one skilled in the art that yet would be encompassed by the spirit and scope of the invention. For example, the above description has been given from the point of view of the present invention being utilized as a divider. However, as with all dividers, it can also be used as a combiner by reversing the flow of current.

What is claimed is:

1. A passive electromagnetic power divider/combiner for simultaneously outputting power both axially and radially, said divider/combiner comprising:

an elongated input conductor for conveying electromagnetic input energy;

generally orthogonal to the input conductor, a substantially planar dielectric layer overlaid with several elongated generally radial output conductors, each of which is coupled to the input conductor and each of which conveys an equal percentage of the power in the input conductor, wherein the total power outputted by the radial output conductors is less than the power in the input conductor; and generally colinear with the input conductor and dielectrically separated therefrom by the dielectric layer, an elongated axial output conductor capacitively coupled to the input conductor via several radially arranged, substantially identical combiner impedance transformers, each of which is capacitively coupled to one of the radial output conductors across dielectric layer, and each of which is connected to the axial output conductor, wherein the input conductor power that is not outputted by the radial output conductors is outputted by the axial output conductor.

2. The divider/combiner of claim 1 wherein the radial output conductors are respectively coupled to the input conductor by a set of substantially identical divider impedance transformers each a quarter wavelength long at the design frequency.

3. The divider/combiner of claim 2 wherein each divider impedance transformer is an elongated tapered conductor having a wide end connected to an end of a corresponding radial output conductor, and a narrow end connected to an end of the input conductor.

4. The divider/combiner of claim 2 wherein the divider impedance transformers are equispaced radially on a substantially flat divider dielectric disk that is generally orthogonal to the input conductor.

5. The divider/combiner of claim 2 wherein the divider impedance transformers are fabricated by a process of photolithography.

6. The divider/combiner of claim 1 further comprising a set of substantially identical isolation resistors, each isolation resistor separating an adjacent pair of radial output conductors, said resistors insuring that the phase of the electromagnetic energy within each radial output conductor is substantially identical at identical distances therealong.

7. The divider/combiner of claim 1 wherein the dielectric layer has an input side to which the radial output conductors are attached, said dielectric layer separating the input conductor from the axial output conductor;

wherein the percentage of power that couples from the input conductor to the axial output conductor is regulated by the thickness of the dielectric layer, the thinner the dielectric layer the greater said axial coupling.

8. The divider/combiner of claim 1 in which the combiner impedance transformers are fabricated by a process of photolithography.

9. The divider/combiner of claim 1 wherein:

the number N of radial output conductors is preselected;

the power ratio $R=Pa/Pr2$ is preselected, where Pa is the amount of power flowing through the axial output conductor and Pr2 is the amount of power flowing through each radial output conductor;

Pr3 is the amount of power flowing in each combiner impedance transformer;

the capacitive coupling coefficient $C=Pr3/Pr2$ between each radial output conductor and its associated combiner impedance transformer is calculated from the formula $C=R/N$; and the dielectric layer is made to a thickness such that the calculated value of C is obtained for each of the capacitive couplings between a radial output conductor and a combiner impedance transformer.

10. The divider/combiner of claim 1 wherein the combiner impedance transformers are mounted on a substantially flat combiner dielectric disk that is generally orthogonal to the axial output conductor.

11. A method for effectuating fine adjustments in the percentage of power that is coupled from the input conductor to the axial output conductor of the divider/combiner of claim 10, said method comprising the step of:

rotating the combiner dielectric disk in its plane.

* * * * *